US006158505A

United States Patent [19]

Araujo

[11] Patent Number: 6,158,505

[45] Date of Patent: Dec. 12, 2000

[54] BLADE SEAL FOR A SHEARING BLIND RAM IN A RAM TYPE BLOWOUT PREVENTER

[75] Inventor: Raul Araujo, Pasadena, Tex.

[73] Assignee: Cooper Cameron Corporation, Houston, Tex.

[21] Appl. No.: 09/386,578

[22] Filed: Aug. 30, 1999

[51] Int. Cl.[7] ..... E21B 29/08; E21B 33/06

[52] U.S. Cl. ..... 166/55; 166/297; 251/1.3

[58] Field of Search ..... 166/55, 55.3, 297, 166/298, 323; 251/1.1, 1.3

[56] References Cited

U.S. PATENT DOCUMENTS

| | | | |
|---|---|---|---|
| 3,766,979 | 10/1973 | Petrick | 166/55 |
| 3,817,326 | 6/1974 | Meynier, III | 166/55 |
| 4,081,027 | 3/1978 | Nguyen | 166/55 |
| 4,341,264 | 7/1982 | Cox et al. | 166/55 |
| 4,347,898 | 9/1982 | Jones | 166/55 |
| 4,537,250 | 8/1985 | Troxell, Jr. | 166/55 |
| 4,540,046 | 9/1985 | Granger et al. | 166/55 |
| 5,005,802 | 4/1991 | McWhorter et al. | 251/1.3 |
| 5,360,061 | 11/1994 | Womble | 166/55 |
| 5,515,916 | 5/1996 | Haley | 166/55 |
| 5,713,581 | 2/1998 | Carlson et al. | 277/188 R |

OTHER PUBLICATIONS

Cooper Cameron Corp., BOP Replacement Parts Catalog, Jul. 1998, p. 41, "T BOP Shearing Blind Rams ".

Cooper Oil Tool Division, Cooper Industries; Engineering Bulletin Errata Sheet, EB 700 D, Rev. E1; Jun. 23, 1995; p. 6, Figure 1, "DS Shearing Blind Ram".

*Primary Examiner*—Frank Tsay

*Attorney, Agent, or Firm*—Jackie Lee Duke

[57] ABSTRACT

A blade seal for a shearing blind ram designed for use in a standard ram-type blowout preventer used in oil and gas drilling operations is disclosed. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The blade seal includes a generally planar shaped central member that tapers from one end to the other and is constructed of rubber. A pair of metal caps are bonded to the lateral edges of the blade seal to aid in preventing extrusion. The lower face of the rubber central member includes a groove adjacent to the metal cap to aid in preventing extrusion of the rubber. A pair of the blade seals is used in the upper ram of the shearing blind ram assembly. The opposing lower ram has a upwardly facing surface that seals against the pair of blade seals after the pipe is sheared.

9 Claims, 4 Drawing Sheets

BLADE SEAL FOR A SHEARING BLIND RAM IN A RAM TYPE BLOWOUT PREVENTER

BACKGROUND OF THE INVENTION

1. Field of the Invention

This invention relates to an improved blade seal for use in a shearing blind ram for a ram-type blowout preventer used in oil and gas drilling operations. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted on the ends of the pistons which extend into the blowout preventer bore. When these pistons are moved to a closed position, commonly referred to as "closing the blowout preventer" or "closing the rams", the vertical bore of the blowout preventer is sealed and the "kick" is contained. These "packers" are available in a variety of configurations designed to seal the blowout preventer bore when the opposing pistons are moved to their closed position. One type of packer has ends designed to seal around pipe of a specific size in the blowout preventer bore when the blowout preventer is "closed." Other rams are designed to shear through a drill pipe extending through the vertical bore and seal off the bore. It is this type, commonly referred to as "blind shear" rams and the blade seal to be used therein to which the present invention is directed.

These shearing blind rams face a formidable task. They must be able to shear through a piece of drill pipe in the blowout preventer bore and then seal against each other to contain the well bore pressure during a "kick". The shearing blind rams must form a pressure tight seal during a kick until the well bore pressure can be controlled. The well bore pressure can reach several thousand pounds per square inch during a "kick." The shearing blind ram has various rubber seal elements attached to it to ensure a complete seal of the blowout preventer bore.

These seal elements, including the blade seal of the present invention, are exposed to tremendous well bore pressures. The blade seal of the current invention offers a substantial improvement by offering a simple, easy to manufacture blade seal that minimizes wear and tear of the elastomeric seal element.

2. Description of Related Art

Various types of shearing blind rams with various blade seals have been shown and used.

U.S. Pat. No. 4,537,250 to J. N. Troxell, Jr. shows a shearing ram utilizing a pair of hardened points to aid in initiating the shearing action. A plain rectangular seal acts as a blade seal.

The shear ram apparatus shown in U.S. Pat. No. 4,540,046 to S. W. Granger et al. discloses a blade seal with the rubber element bonded to a metal member.

U.S. Pat. No. 5,360,061 to L. M. Womble shows a blowout preventer with tubing shear rams designed to control the shape of the sheared pipe end.

U.S. Pat. No. 5,713,581 to D. W. Carlson et al. shows a blade seal of nitrile rubber with uniformly dispersed synthetic, non-cellulosic fibers to aid in preventing seal rollover.

SUMMARY OF THE INVENTION

The blade seal for a shearing blind ram of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The blade seal includes a generally planar shaped central member that tapers from one end to the other and is constructed of rubber. A pair of metal caps are bonded to the lateral edges of the blade seal to aid in preventing extrusion. The lower face of the rubber central member includes a groove adjacent to the metal cap to aid in preventing extrusion of the rubber. A pair of the blade seals are used in the upper ram of the shearing blind ram assembly. The opposing lower ram has a upwardly facing surface that seals against the pair of blade seal after the pipe is sheared.

A principal object of the present invention is to provide an improved blade seal for use in shearing blind rams that has an improved life cycle and fits in existing blowout preventers.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
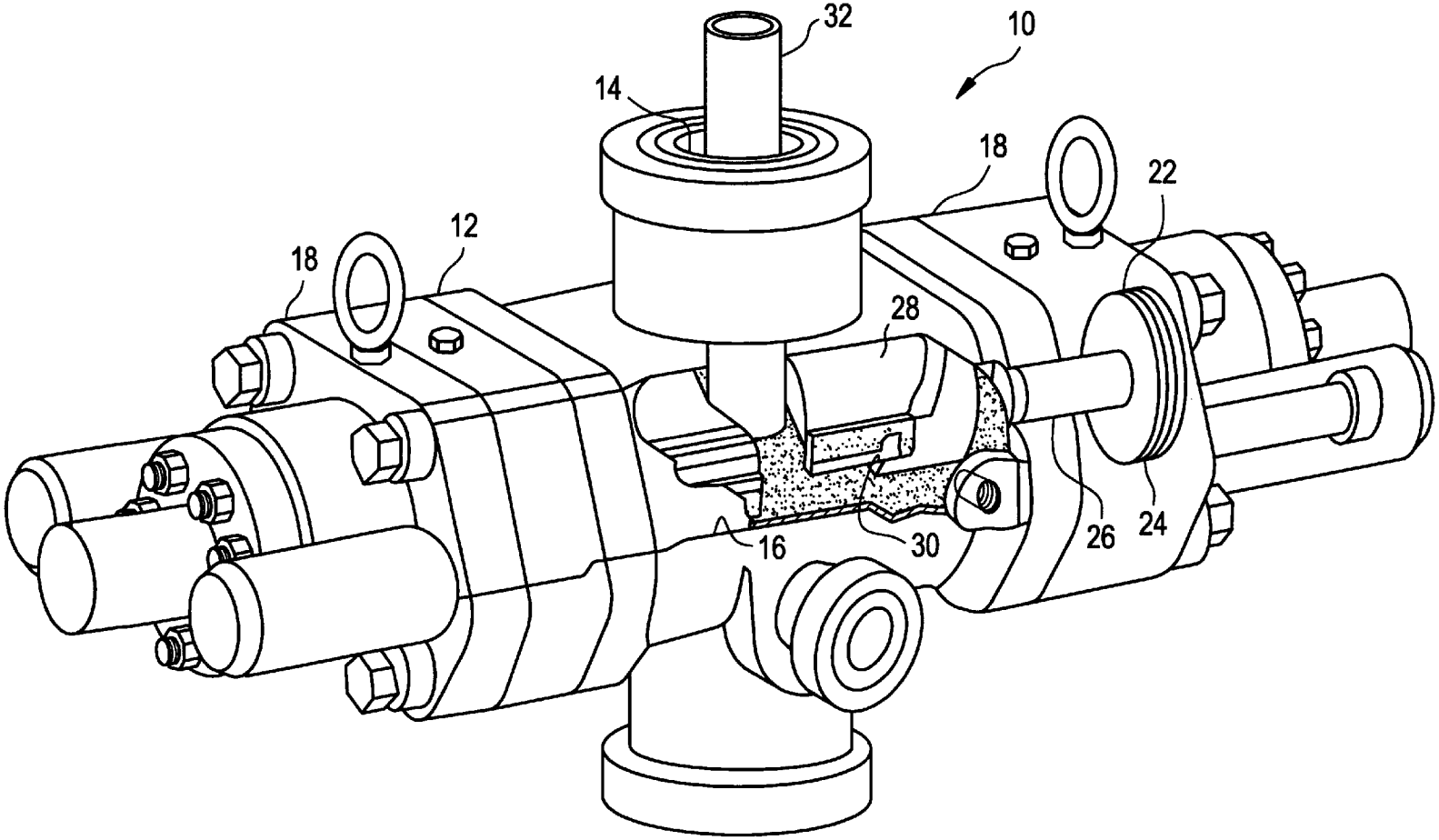
FIG. 1 is a perspective view with a cutaway section of a shearing blind ram assembly utilizing the blade seal of the present invention installed in a typical ram-type blowout preventer used in oil and gas drilling operations.

With reference to the drawings, and particularly to FIG. 1, an isometric view of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with studs 20 and aligned with laterally disposed guideways 16. Each bonnet assembly 18 includes an actuation means 22, including a piston 24 and connecting rod 26 (shown in phantom). While only one guideway 16 and actuation means 22 is shown, it is understood by those of ordinary skill in the art that there is a pair of opposed guideways 16 and actuation means 22. Each connecting rod 26 is connected to a shearing blind ram assembly 28. Shearing blind ram assembly 28 includes a pair of blade seals 30 of the present invention. Actuation means 22 allows ram and shearing blind ram assembly 30 to be reciprocated within guideways 16.

Figure 2:
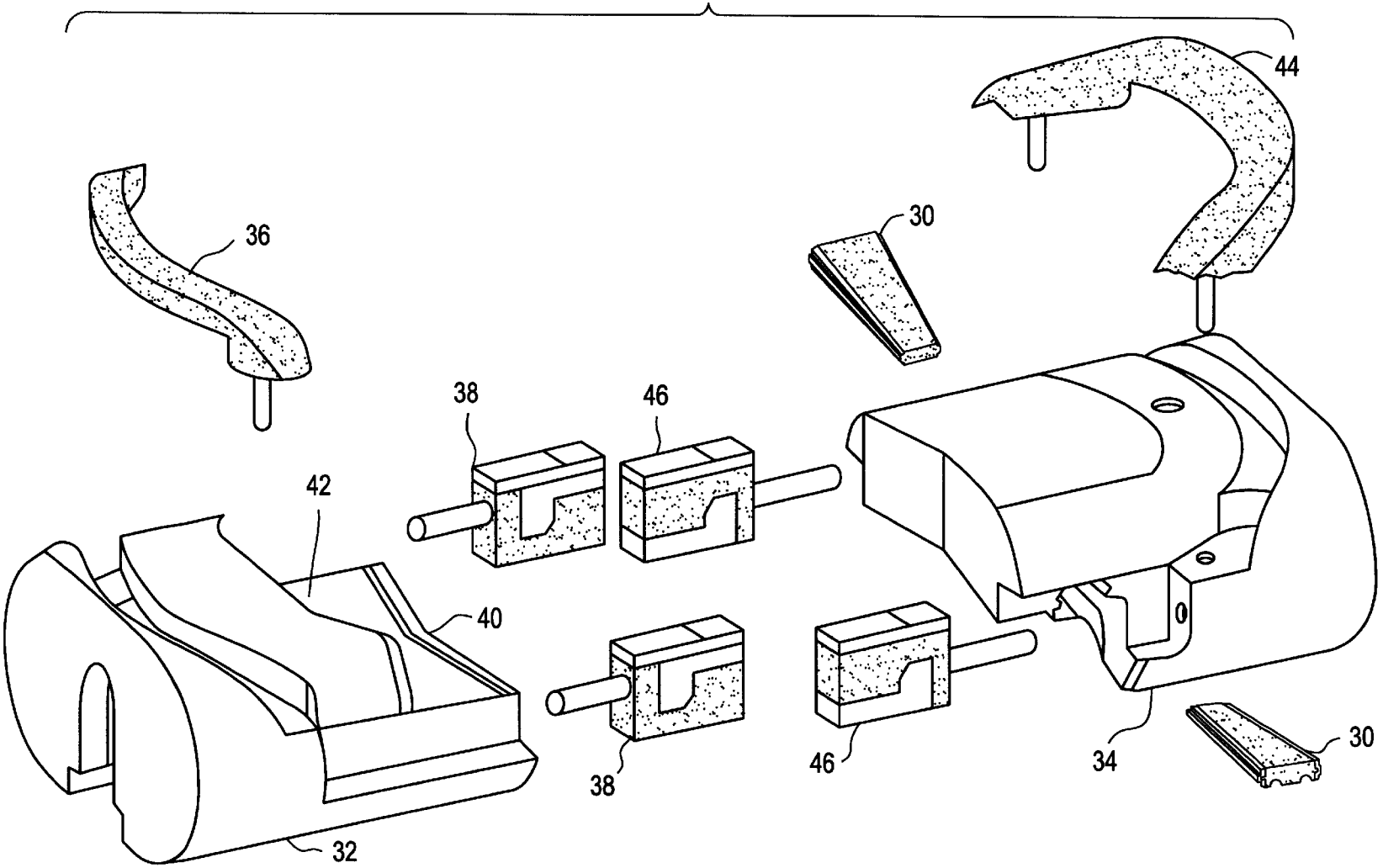
FIG. 2 is an exploded view of the shearing blind ram assembly.

Shearing blind ram assembly 28 is shown in exploded view in an exploded view in FIG. 2 to aid in understanding the relationship between the parts. Shearing blind ram assembly 28 includes lower ram 32 and upper ram 34. Lower ram 32 includes top seal 36 and side seals 38 that seal against guideways 16. Lower ram 32 includes shear blade 40 positioned on its leading edge and seal surface 42. Upper ram 34 includes top seal 44 and side seals 46 that seal in guideways 16 in a manner similar to lower ram 32. Blade seals 30 are positioned on the lower face of upper ram 34.

Figure 3:
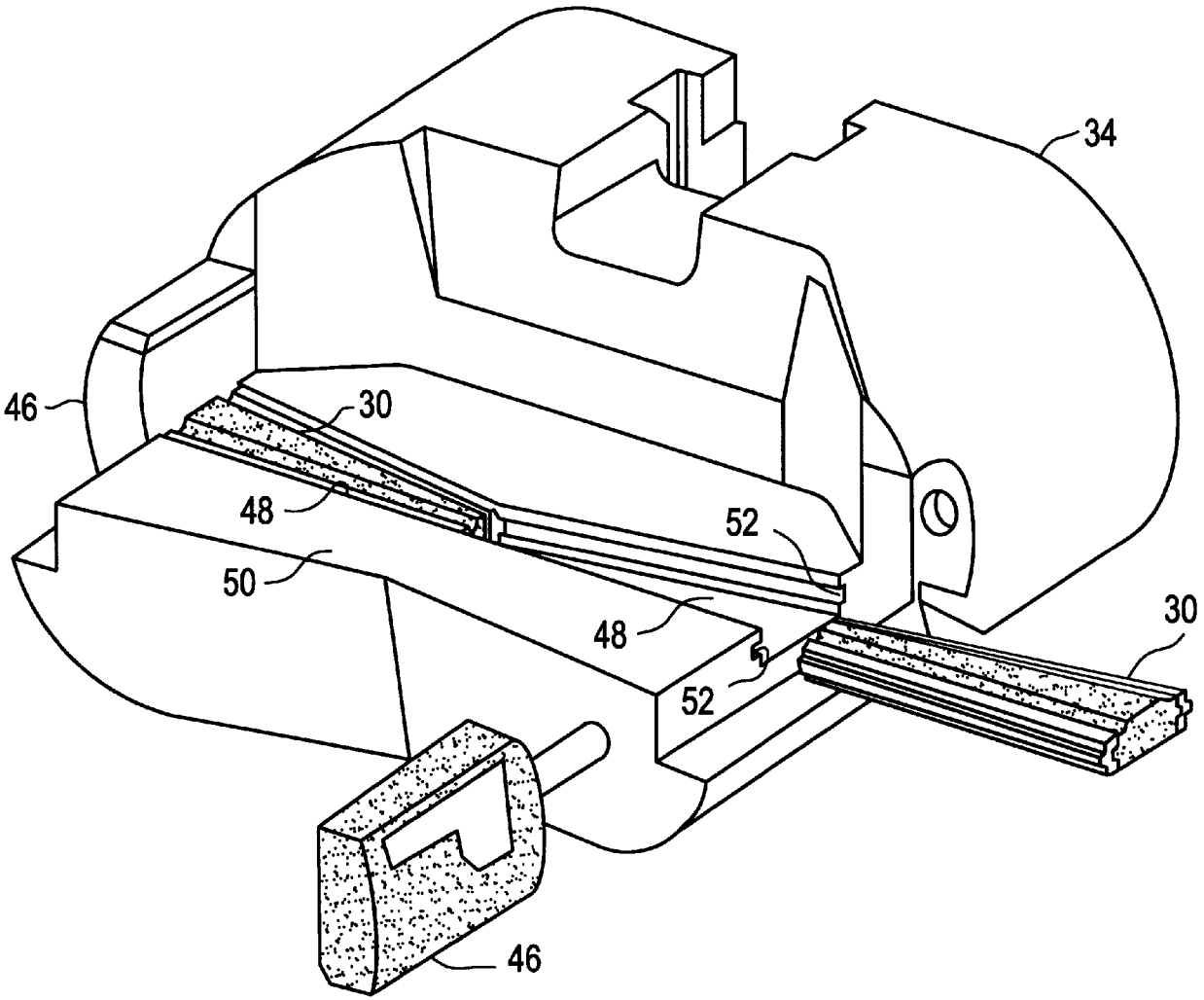
FIG. 3 is a partially exploded view of the upper ram of a shearing blind ram assembly shown in an inverted position.

Referring to FIG. 3, upper ram 34 is shown inverted from its position of FIG. 2 to better illustrate the positioning of blade seals 30 therein. A pair of tapered grooves 48 are machined in lower face 50 of upper ram 34. Tapered grooves 48 include orientation grooves 52 in their lateral walls to align and position with blade seals 30.

Figure 4:
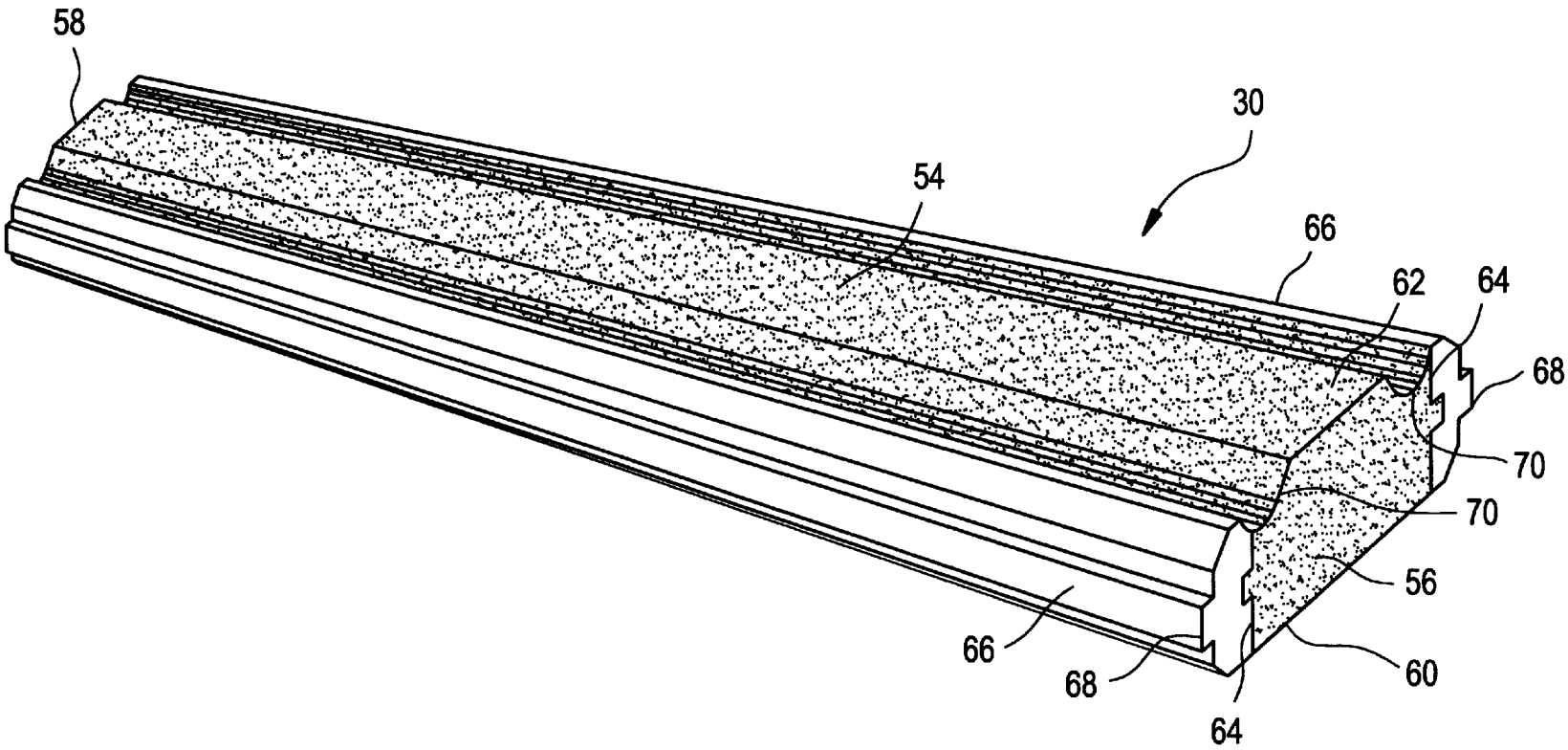
FIG. 4 is a perspective view of the blade seal of the present invention.

As best seen in FIG. 4, blade seal 30 is a generally planar member 54 of rubber having a first end 56 and a second end 58. First end 56 and second end 58 are connected by upper surface 60 and lower surface 62 (Blade seal 30 is shown inverted from its normal orientation). Lateral sides 64 taper from first end 56 to second end 58. Outer caps 66 are bonded to lateral sides 64 with shoulder 68 formed thereon and sized to fit it grooves 52 as shown in FIG. 3. Longitudinal grooves 70 are formed in member 54 parallel and adjacent to outer caps 66. Longitudinal grooves 70 aid in preventing extrusion of rubber planar member 54 during operation.

A typical sequence of operation is as follows. With shearing blind ram assembly 28 installed in blowout preventer 10, the rams are closed. This causes pipe 32 to be sheared and lower face 50 of upper ram 34 and seal surface 42 of lower ram 32 to slide over one another in close fitting relationship. Continued movement causes seal surface 42 of lower ram 32 to contact and seal against lower surface 62 of blade seals 30. Top seals 36 and 44 and side seals 38 and 46 also seal against guideways 16 to ensure a complete seal of the vertical bore 14 after shearing.

The construction of my improved blade seal for a shearing blind ram will be readily understood from the foregoing description and it will be seen that I have provided an improved blade seal that has an improved life cycle and fits in existing blowout preventers. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A ram-type blowout preventer for oil and gas drilling operations including a shearing blind ram, comprising:

a body with a vertical bore;

a pair of opposing bonnet assemblies laterally disposed in said body;

a pair of opposing shearing blind rams laterally moveable within said bonnet assemblies;

a pair of blade seals for sealing against an opposing shearing blind ram disposed in one of said shearing blind rams, each of said blade seals is a generally planar member having a first end and a second end;

said first end and said second end of said generally planar member connected by an upper surface and a lower surface and a pair of lateral sides, said lateral sides tapering from said first end of said generally planar member to said second end of said generally planar member, said pair of lateral sides each having a outer cap;

said generally planar member is molded of rubber; and, said lower surface of said generally planar member includes a longitudinal groove parallel to said lateral sides.

2. A ram-type blowout preventer for oil and gas drilling operations including a shearing blind ram according to claim 1, wherein:

said outer cap is formed of metal.

3. A blade seal for a shearing blind ram for a ram-type blowout preventer used in oil and gas drilling operations according to claim 2, wherein:

said outer cap includes a shoulder formed thereon for engagement with a complementary groove formed in said shearing blind ram.

4. A shearing blind ram assembly for a ram-type blowout preventer used in oil and gas drilling operations, comprising:

an upper ram and a lower ram;

said upper ram and said lower ram including top seals and side seals for sealing in a guideway of a ram-type blowout preventer;

a plurality of blade seals positioned on the lower face of said upper ram;

said lower ram including a seal surface for engagement with said plurality of blade seals when said shearing blind ram assembly is closed;

each of said blade seals is a generally planar member having a first end and a second end;

said first end and said second end of said generally planar member connected by an upper surface and a lower surface and a pair of lateral sides, said lateral sides tapering from said first end of said generally planar member to said second end of said generally planar member, said pair of lateral sides each having a outer cap;

said generally planar member is molded of rubber; and, said lower surface of said generally planar member includes a longitudinal groove parallel to said lateral sides.

5. A shearing blind ram assembly for a ram-type blowout preventer used in oil and gas drilling operations according to claim 4, wherein:

said outer cap is formed of metal.

6. A shearing blind ram assembly for a ram-type blowout preventer used in oil and gas drilling operations according to claim 5, wherein:

said outer cap includes a shoulder formed thereon for engagement with a complementary groove formed in said upper ram.

7. A blade seal for a shearing blind ram for a ram-type blowout preventer used in oil and gas drilling operations, comprising:

a generally planar member having a first end and a second end;

said first end and said second end of said generally planar member connected by an upper surface and a lower surface and a pair of lateral sides;

said lateral sides tapering from said first end of said generally planar member to said second end of said generally planar member;

said pair of lateral sides each having a outer cap;

said generally planar member is molded of rubber; and, said lower surface of said generally planar member includes a longitudinal groove parallel to said lateral sides.

8. A blade seal for a shearing blind ram for a ram-type blowout preventer used in oil and gas drilling operations according to claim 7, wherein:

said outer cap is formed of metal.

9. A blade seal for a shearing blind ram for a ram-type blowout preventer used in oil and gas drilling operations according to claim 8, wherein:

said outer cap includes a shoulder formed thereon for engagement with a complementary groove formed in said shearing blind ram.

* * * * *